United States Patent [19]

Kennedy

[11] 4,200,316

[45] Apr. 29, 1980

[54] BARREL RING LOCK ASSEMBLY

[75] Inventor: Edward S. Kennedy, Strongsville, Ohio

[73] Assignee: Group Industries Incorporated, Cleveland, Ohio

[21] Appl. No.: 914,210

[22] Filed: Jun. 12, 1978

[51] Int. Cl.[2] ..... E05C 19/18

[52] U.S. Cl. ..... 292/256.67

[58] Field of Search ..... 24/279–286; 292/256.67, 256.69; 285/350

[56] References Cited

U.S. PATENT DOCUMENTS

| | | | |
|---|---|---|---|
| 2,709,524 | 5/1955 | Russell et al. | 292/256.67 X |
| 2,968,508 | 1/1961 | Campbell et al. | 292/256.67 |
| 3,447,825 | 6/1969 | Santoni | 292/256.67 |
| 3,907.349 | 9/1975 | Kane | 292/256.67 |

FOREIGN PATENT DOCUMENTS

| | | | |
|---|---|---|---|
| 808398 | 2/1959 | United Kingdom | 292/256.67 |

*Primary Examiner*—Richard E. Moore

*Attorney, Agent, or Firm*—Fay & Sharpe

[57] ABSTRACT

A steel closure ring assembly for a barrel or drum of the split ring type that is adapted to close the chime of a barrel and its cover. A pair of metal fittings, one on each end of the ring, tighten the ring and swage it around the barrel to make a tight, liquid-proof seal even under drop test conditions.

Each metal fitting incorporates a machine nut with a folded metal housing enclosing its exterior sides while leaving the interior or threaded sides accessible. The nut may have four or six sides with an arcuate member extending from one side in an outward direction or in a direction away from the encapsulated nut, which is adapted to closely conform to the curved metal ring and thereby extend over the chime of the barrel.

A tang extends from the sheet metal housing to the side of the fittng away from the end of the split ring and also over the chime and is attached by means of welding.

7 Claims, 11 Drawing Figures

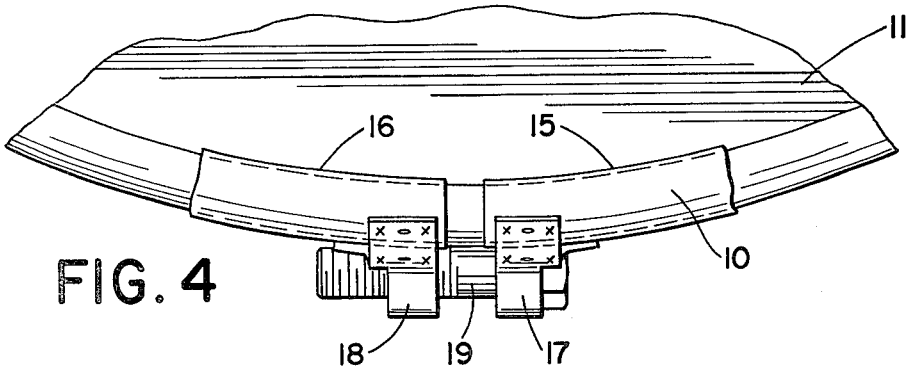
FIG. 4
FIG. 6
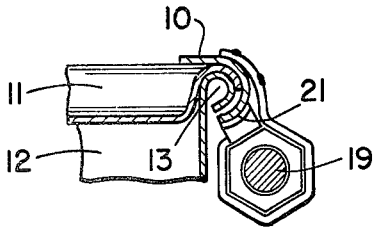
FIG. 5
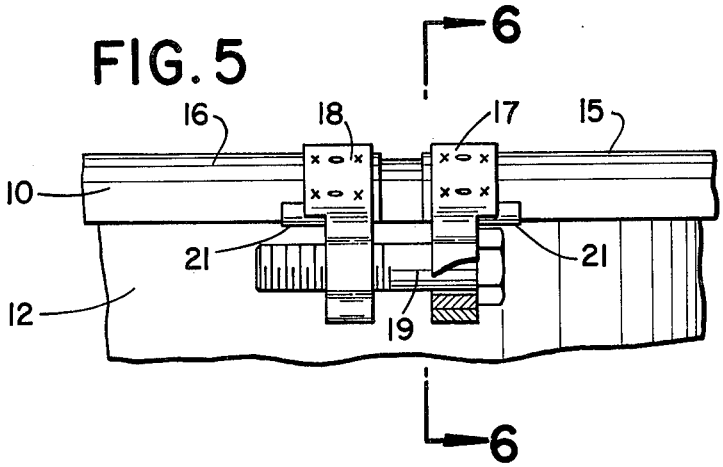
FIG. 7
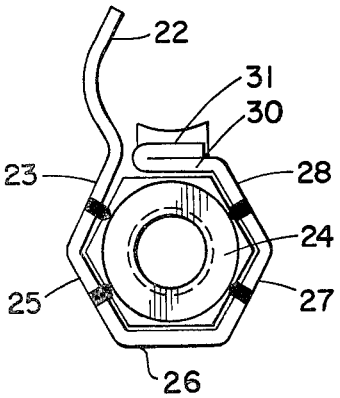
FIG. 8
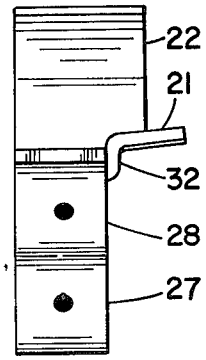
FIG. 9
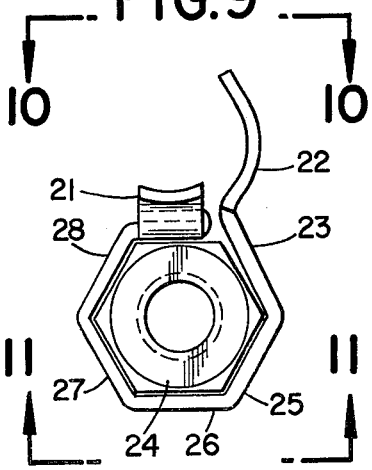
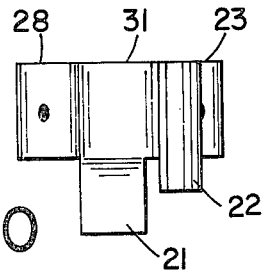
FIG. 10
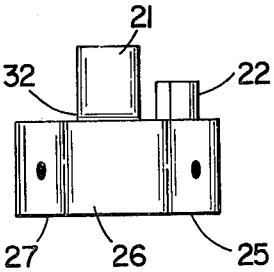
FIG. 11

BARREL RING LOCK ASSEMBLY

BACKGROUND OF THE INVENTION

This invention relates to a steel ring lock assembly for a barrel or drum which may be sealed liquid tight.

In general, drums of this type have been known in the prior art as exemplified in the following U.S. patents:

| | |
|---|---|
| Santoni | 3,447,825 |
| Armstrong | 3,346,139 |
| Verbiar | 2,915,330 |
| Easterday | 2,625,295 |
| Klygis | 3,022,103 |
| Kohout | 2,633,616 |
| French Patent | 1,525,239 |

Drums are used for the handling and transporting of bulk materials. As such, they must close tightly and seal in carload quantities of materials. It is the Interstate Commerce Commission's responsibility to regulate the standards applicable to barrels and their ring assemblies.

The development in this invention is particularly to a stamped metal ring closure that is welded to a standard hex nut. The ring is of a split ring type which is adapted to close the chime of a barrel and its cover. For this purpose a pair of metal fittings is employed, one on each end of the split ring which is welded to the metal fittings. Tightening is accomplished by means of a threaded fastener.

The metal fittings of the present invention are fashioned by encapsulating a nut to enclose the exterior sides while leaving the interior sides accessible. Extending outwardly from the nut is an arcuate member or tab which conforms to the ring assembly on one side and on the side adjacent to the metal fitting. The nut when encapsulated forms a semicircular-shaped enclosure which may then be welded to the ring.

A tang extends from the adjacent side to the side of the fitting away from the ends of the split ring, it being coextensive with the chime and welded thereto. One nut is threaded while the other is left plain so that a threaded fastener or bolt closure is permitted to take up the ends of the ring with the metal fittings attached thereto, thereby providing a tight fitting ring assembly for a barrel. Preferably, the ring assembly is canted about 4° to aid in alignment of the threaded fastener The prior art patents cited above, in an attempt to meet quality standards, seem, at best, modestly expensive. The welded type, as for example Klygis U.S. Pat. No. 3,022,103, is preferred by some users. Later prior art patents used a horseshoe-shaped ring (0.093") which must be welded to a forged lock ring assembly including a bolt for tightening up the ends of the ring to force the lid, gasket and drum together.

BRIEF DESCRIPTION OF THE INVENTION

In accordance with the present invention, one aspect is to make a durable closure ring fitting assembly for a barrel which may be fabricated from stamped parts and adapted to enclose a nut by means of welding thereto.

Special features of the invention include fittings that are welded to the ring and to the nut in order to form an arcuately shaped member or tab, which member is then welded to the ring end, and a plurality of folded sides is welded to the nut. The closing side forms a semicircular portion which is supported by a tang that extends in a direction away from the ring end and is welded to the underside of the ring as an aid in providing a 4° canted offset to the fitting.

BRIEF DESCRIPTION OF THE DRAWINGS

Details of the preferred embodiment of this invention are described in detail in this specification and are illustrated in the accompanying drawings which form a part thereof, wherein:

FIG. 4 is an enlarged top view of the barrel ring lock assembly;

FIG. 5 is an enlarged side view of the barrel ring lock assembly;

FIG. 6 is a cross-sectional view taken along lines 6—6 of FIG. 5;

FIG. 7 is a left side view of one fitting of the ring lock assembly;

FIG. 8 is an elevational view of the fitting shown in FIG. 7;

FIG. 9 is a right side view of the fitting shown in FIG. 7;

FIG. 10 is a view taken along the lines 10—10 of FIG. 9; and

FIG. 11 is a view taken along the lines 11—11 of FIG. 9.

DESCRIPTION OF THE PREFERRED EMBODIMENT

Figure 1:
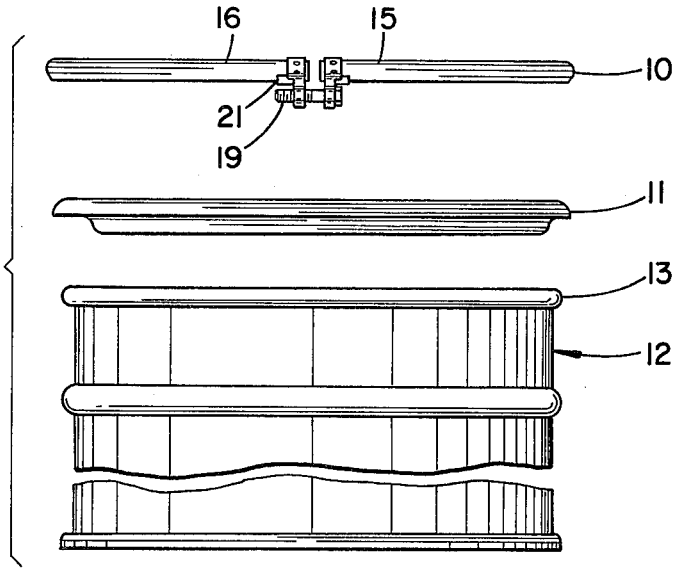
FIG. 1 is a partial exploded view of the barrel, cover and barrel ring lock assembly of the present invention.
Figure 2:
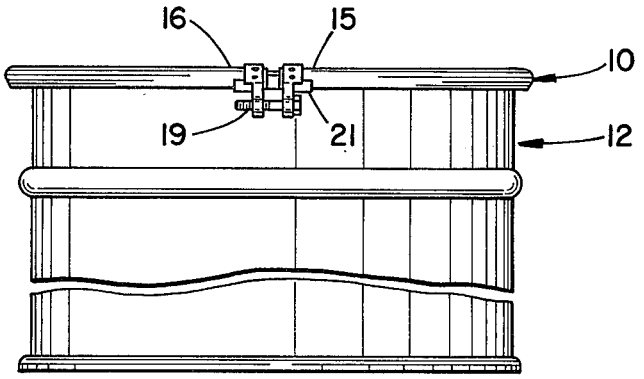
FIG. 2 is a view of the barrel ring lock assembly shown in assembled position.
Figure 3:
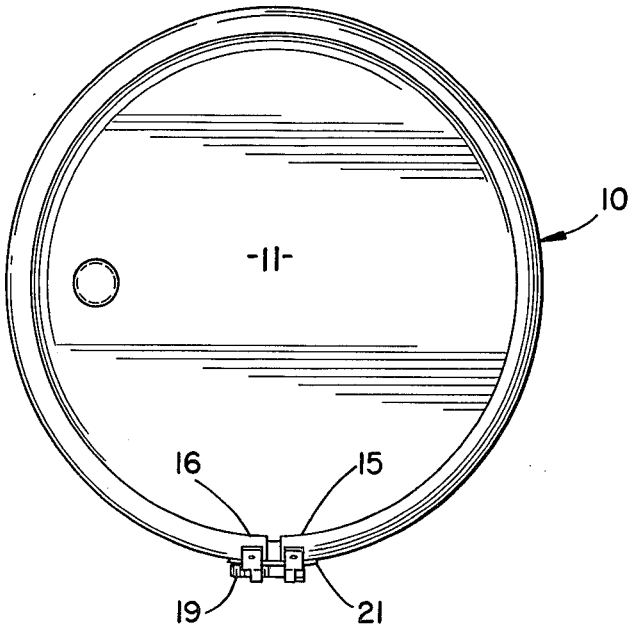
FIG. 3 is a top plan view of the barrel and barrel ring lock assembly.

Referring now to the drawings wherein the showings are for purposes of illustrating the preferred embodiment of the invention only and not for purposes of limiting same, the figures concern the following:

FIG. 1 is directed to the barrel ring lock assembly 10, cover 11 and the barrel 12 with chime 13 and barrel ring 14. FIGS. 2 and 3 show the assembly 10 in position and tightened up.

FIG. 4 shows the ends of ring 15 and 16 with the fittings secured thereto as by welding at 17 and 18, and held together by threaded fastener or bolt closure 19.

The manner in which the lock ring ends 15 and 16 are welded to fittings 17 and 18 and drawn up by fastener 19 is illustrated in FIG. 5.

FIG. 6 demonstrates how the forces on the lock ring are encompassed almost 180° so that the tang 21 extends in a direction away from the ends of the lock ring in order to support fittings 17 and 18 on the lock ring, shown canted 4° in FIG. 8, and thereby threading of fastener 19 upon assembly over the cover and chime 13 of the barrel is facilitated.

With respect to the left side view of the fitting in FIG. 7, there is an arcuate-shaped member 22 which curves to fit and conform with the lock ring. Attached to said member are sides to the enclosing or encapsulating sheet metal fitting. Adjacent side 23 is positioned on one of the sides of hexagonal nut 24, and extending around the periphery thereof are sides 25, 26, 27 and 28 in sequential alignment. The last side or section 30 enclosing the nut shows a portion which is folded back as at 31 to reinforce tang 21. The position of the sheet metal side 30 may be seen in connection with FIGS. 7–9, where the folded layers are visible as is the tang which is shown canted 4° and curved slightly to mate with the underside of the lock ring when it is welded in place. In FIG. 8 there is step 32 as well as the cant illustrated. The arcuate-shaped member 23 extends around the lock ring a greater distance than do the sides of the sheet metal encapsulation, referring here to FIGS. 4, 5, 8, 10 and 11. It is to be understood that the sheet metal encapsulation could either enclose a square bolt or an octagonal bolt. The nut is projection welded in the hex stamping at four places, and the fittings are welded to the barrel ring at the tang and at four places on the arcuate-shaped member or tab.

The lock ring assembly of this invention may be either right or left handed so as to fit the barrel rings. One bolt is threaded and the other is plain. A bolt or fastener passes through the fittings to tighten up the lock ring assembly, swaging the barrel ring around the cover or lid and onto the barrel. In operation, attention is directed to the stresses that are set up in the fitting, where it is noted that the arcuate-shaped member is welded to the ring end and projection welded to the nut.

On the opposite side the tang is welded to the underside of the ring, i.e. angularly displaced around the ring and welded to the nut so that forces are transmitted evenly to the ring and to the nut. Canting of the tang and folding of the encapsulating sheet metal assist in providing a supporting lock ring assembly for the transmission of the rather high forces obtained from the bolt to the tang and folded side, whereby even distribution of forces act on the cover and place pressure on the chime to seal the barrel.

The invention has been described with reference to a preferred embodiment. Obviously, modifications and alternations will occur to others upon the reading and understanding of this specification. It is the intent herein to include all such modifications and alterations insofar as they come within the scope of the appended claims or the equivalents thereof.

What is claimed is:

1. A steel lock ring assembly for a barrel or drum comprising:

a split and curved metal ring adapted to close the chime of the barrel or drum and its cover;

metal fittings on the ends of said ring for tightening up the ring, each fitting to include a machine nut with each nut having a sheet metal encapsulation on its exterior surface;

an arcuate-shaped member attached to the marginal edge of the sheet metal encapsulation adapted to closely conform with the curved metal ring and extend over the chime of the barrel or drum;

a tang extending to the side of the fitting in a direction away from the end of the split ring and positioned to be on the underside of the chime of the barrel or drum;

said sheet metal encapsulation member and tang being securely fastened to the ends of the ring and to the nuts, with one of said nuts being threaded and the other plain; and a threaded bolt closure means for securing the ends of the ring and fittings together.

2. The ring lock assembly as defined in claim 1 wherein the tang is canted 4° in towards the ring for axial alignment of the bolt closure.

3. The ring lock assembly as defined in either claim 1 or 2 wherein the tang is offset from the sheet metal by more than twice the thickness of the sheet metal encapsulation and is curved so as to conform with the ring to which it is secured.

4. The ring lock assembly as defined in claims 1 or 3 wherein the sheet metal encapsulation is folded back against itself on its closing side and adjacent the tang so as to form an enclosure which is almost in a semicircle with the arcuate-shaped member.

5. A fitting adapted to close the split ring of a barrel and comprising:

a nut and a folded sheet metal casing for enclosing said nut and leaving access to the interior sides of said nut, with each side of the nut having one section closely mating with its interior sides;

a member extending from one end of the folded sheet metal in an outward direction and forming an arc which is adapted to conform with the ends of the split barrel ring;

a tang extending longitudinally to the side of the nut from the opposite end of the folded sheet metal and adapted to be attached to the barrel ring, said tang being offset in an outward direction from the axis of the nut to provide a cant for the fitting.

6. The fitting as defined in claim 5 wherein the last section enclosing the nut at the tang attachment provides for a second layer of metal folded back against itself for reinforcement of said tang.

7. The fitting as defined in either claim 5 or 6 wherein the tang is offset by more than twice the thickness of the sheet metal so as to provide for a 4° cant for the fitting to aid in axial alignment of said fitting.

* * * * *